US011628538B2

(12) United States Patent
Kivisto et al.

(10) Patent No.: US 11,628,538 B2
(45) Date of Patent: Apr. 18, 2023

(54) VALVE MOUNT FOR SHOT BLASTER PLENUM VALVE

(71) Applicant: National Flooring Equipment, Inc., Minneapolis, MN (US)

(72) Inventors: John A. Kivisto, Oak Grove, MN (US); Mark D. Anderson, Champlin, MN (US)

(73) Assignee: National Flooring Equipment, Inc., Minneapolis, MN (US)

( * ) Notice: Subject to any disclaimer, the term of this patent is extended or adjusted under 35 U.S.C. 154(b) by 959 days.

(21) Appl. No.: 16/459,873

(22) Filed: Jul. 2, 2019

(65) Prior Publication Data

US 2021/0001449 A1 Jan. 7, 2021

(51) Int. Cl.

| | |
|---|---|
| ***B24C 3/08*** | (2006.01) |
| ***A47L 11/02*** | (2006.01) |
| ***B24B 7/18*** | (2006.01) |
| ***B24C 3/06*** | (2006.01) |

(52) U.S. Cl.

CPC ..... *B24C 3/083* (2013.01); *A47L 11/02* (2013.01); *B24B 7/18* (2013.01); *B24C 3/067* (2013.01)

(58) Field of Classification Search

CPC ..... B24C 7/00; B24C 7/0015; B24C 7/003; B24C 7/0046; B24C 7/0053; B24C 7/0061; B24C 7/0069; B24C 5/06; B24C 5/062; B24C 5/064; B24C 5/066; B24C 5/068; B24C 1/10; B24C 3/067; B24C 3/065; B24C 3/083; A47L 11/02; A47L 11/202; A47L 11/4083; B24B 7/18

USPC ..... 451/80, 87, 88, 92

See application file for complete search history.

(56) References Cited

U.S. PATENT DOCUMENTS

| | | | | |
|---|---|---|---|---|
| 3,380,196 | A * | 4/1968 | Georges | B24C 3/067 451/92 |
| 4,336,671 | A | 6/1982 | Nelson | |
| 5,231,805 | A * | 8/1993 | Sander | B24C 1/086 451/92 |
| 5,975,985 | A * | 11/1999 | Sutherland | B24C 3/067 451/446 |
| 9,272,383 | B1 * | 3/2016 | Dickson | B24B 49/16 |
| 2014/0329444 | A1 | 11/2014 | Yamamoto | |

FOREIGN PATENT DOCUMENTS

| | | | | |
|---|---|---|---|---|
| EP | 0056176 | | 7/1982 | |
| EP | 1384554 | A1 * | 1/2004 | B24C 5/068 |
| EP | 2123402 | | 7/2011 | |
| JP | 09029641 | | 2/1997 | |

OTHER PUBLICATIONS

Schlick (EP-1384554-A1) EspaceNet English Translation, 2004. (Year: 2004).*

* cited by examiner

*Primary Examiner* — Joel D Crandall
*Assistant Examiner* — Makena S Markman
(74) *Attorney, Agent, or Firm* — Bradley J. Thorson; DeWitt LLP

(57) ABSTRACT

The adverse effects associated with high temperatures and warpage of parts of a shot blaster are ameliorated by providing a telescoping sleeve and valve mount and an orifice adaptor to regulate the area of the flow path from a shot reservoir to a metering valve.

16 Claims, 4 Drawing Sheets

1
30
25
-13-
24
-22-
11
-23-
-20-
50
26
12
27
10

VALVE MOUNT FOR SHOT BLASTER PLENUM VALVE

CROSS-REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

The present invention relates to equipment used to prepare a floor for refinishing. More specifically, the present invention relates to shot blasters.

II. Discussion of the Prior Art

Various types of devices are employed to prepare a floor for refinishing. This includes machines designed to scrape tile and carpet from a floor, polishers, grinders, burnishers and shot blasters. National Flooring Equipment, Inc. of Minneapolis, Minn. has been a leading manufacturer and distributor of such equipment for sixty years. National Flooring Equipment offers a series of shot blasters of different sizes and configurations. These include the National HB5 handheld shot blaster, the National A30 self-propelled shot blaster, and the National A12 ride-on shot blaster. While all the shot blasters offered by National are of high quality and effectively treat the floor, National is continually trying to improve its equipment offerings.

Many concrete floors in commercial buildings and residential garages are, for example, finished with epoxy coatings. Over time, resurfacing is required for aesthetic and other reasons. The original surface must be roughened up to permit the new layer of epoxy to properly adhere to the floor. This step of roughening the floor is often performed using a shot blaster.

A shot blaster is designed to blast small metal pellets (shot) onto the floor's surface. Shot blasters include an impeller (referred to as a blast wheel) that provides the force to blast the shot at the floor. The blast wheel of a shot blaster is enclosed in a blast wheel housing which, in some respects, acts like the barrel of a shotgun used for hunting. The blast housing contains and directs the shot to the desired location on the floor to be treated. The housing also protects the user of the machine and others in the vicinity of the machine from being struck and injured by shot ejected from the blast wheel.

Shot blasters also typically include a reservoir that contains a supply of shot and a shot meter that delivers shot in a metered fashion from the reservoir to the shot wheel housing. Shot blasters also typically include a plenum attached to a powerful vacuum that collects and transports the used shot back into the reservoir, and the dust and debris generated by the shot blasting process into a waste receptacle.

During use, the blast wheel housing heats up due to friction. Such friction results from the spinning of the blast wheel, the pieces of shot rubbing against each other as that are blasted toward the floor, and the pieces of shot impacting the surfaces of the blast wheel housing and the parts contained within the blast wheel housing, including the blast wheel itself.

The elevated temperatures caused by friction are readily transmitted to the shot meter, the reservoir and the parts used to couple the shot meter to the blast wheel housing and the reservoir. These elevated temperatures have a propensity to warp such structures. Such warpage can affect the metering of shot to the blast wheel and, thus, the overall performance of the machine. Also, the blast wheels of the shot blaster are routinely replaced. Such warping makes this routine maintenance process more difficult.

A real need, therefore, exists for a simple and effective way to address and accommodate any such warpage that arises.

SUMMARY OF THE INVENTION

The present invention provides various improvements related to control and regulation of the flow of shot to address warpage of components of a shot blaster.

The shot blaster includes a reservoir adapted to contain a supply of shot. This reservoir has a bottom wall having a bottom orifice. The shot blaster also includes a blast wheel housing adapted to contain a blast wheel. The blast wheel housing has a wall with an inner surface and a wall opening.

The shot needs to be transferred from the reservoir to the shot blaster housing. This is achieved by providing a shot meter having at least three main components. These main components include a sleeve, a valve mount, and a valve. An orifice adaptor may also be provided.

The sleeve comprises a first channel extending between a first open end and a second open end. The channel is defined by a first wall section surrounding and extending from the first open end and a second wall section angled from the first wall section and surrounding and extending from the second open end. The sleeve is adapted to extend through the wall opening of the blast wheel housing. The second open end is surrounded by a sleeve flange adapted to engage an area of the inner surface of the wall of the blast wheel housing surrounding the wall opening.

The valve mount has a second channel defined by a conduit having a top section surrounding a top opening and a bottom section surrounding a bottom opening. A conduit flange extends from the top section surrounding the top opening. The conduit flange is adapted to be coupled to the bottom wall of the reservoir about the bottom orifice of the reservoir in a manner that allows for adjustment. The valve mount may be provided with a pair of upwardly protecting attachment pins extending through elongate slots in the bottom wall of the reservoir. The pins are adapted to slide back and forth in these slots to enable the valve mount to be properly aligned relative to the bottom wall and orifice of the reservoir. The pins are threaded. Standard washers and nuts cooperate with the pins to fix the plate and plate orifice in the desired position relative to the bottom wall and bottom orifice of the reservoir. The bottom section of the conduit of the valve mount is adapted to be inserted into the first open end of the sleeve. Further, the valve mount and first wall section of the sleeve are adapted to telescope with respect to each other.

The valve is mounted in the second channel of the valve mount. This valve may be of any suitable type, for example, a butterfly valve. When a butterfly valve is employed, the butterfly valve comprises an axle extending across the diameter of the second channel and a leaflet coupled to the axle. The leaflet and axle are adapted to rotate relative to the valve mount between a closed position restricting the flow of shot and an open position permitting shot to flow from the reservoir. The degree of opening is selectable to regulate the rate of flow of shot from the reservoir past the valve.

The orifice adaptor is mounted upstream of the valve. In some embodiments, the orifice adaptor comprises a plate having plate orifice adapted to be adjustably aligned relative to bottom orifice of the reservoir to regulate the effective size of a flow path between the bottom orifice of the reservoir and the top opening of the valve mount.

The valve may be adjusted to regulate the flow of shot from the reservoir through the valve mount and sleeve to the blast wheel housing. Likewise, the orifice adaptor may be adjusted to regulate the flow of shot from the reservoir through the valve mount and sleeve to the blast wheel housing.

BRIEF DESCRIPTION OF THE DRAWINGS

The foregoing features, objects and advantages of the invention will become apparent to those skilled in the art from the following detailed description of the preferred embodiment, especially when considered in conjunction with the accompanying drawings in which like numerals in the several views refer to corresponding parts.

DESCRIPTION OF THE PREFERRED EMBODIMENT

Figure 1:
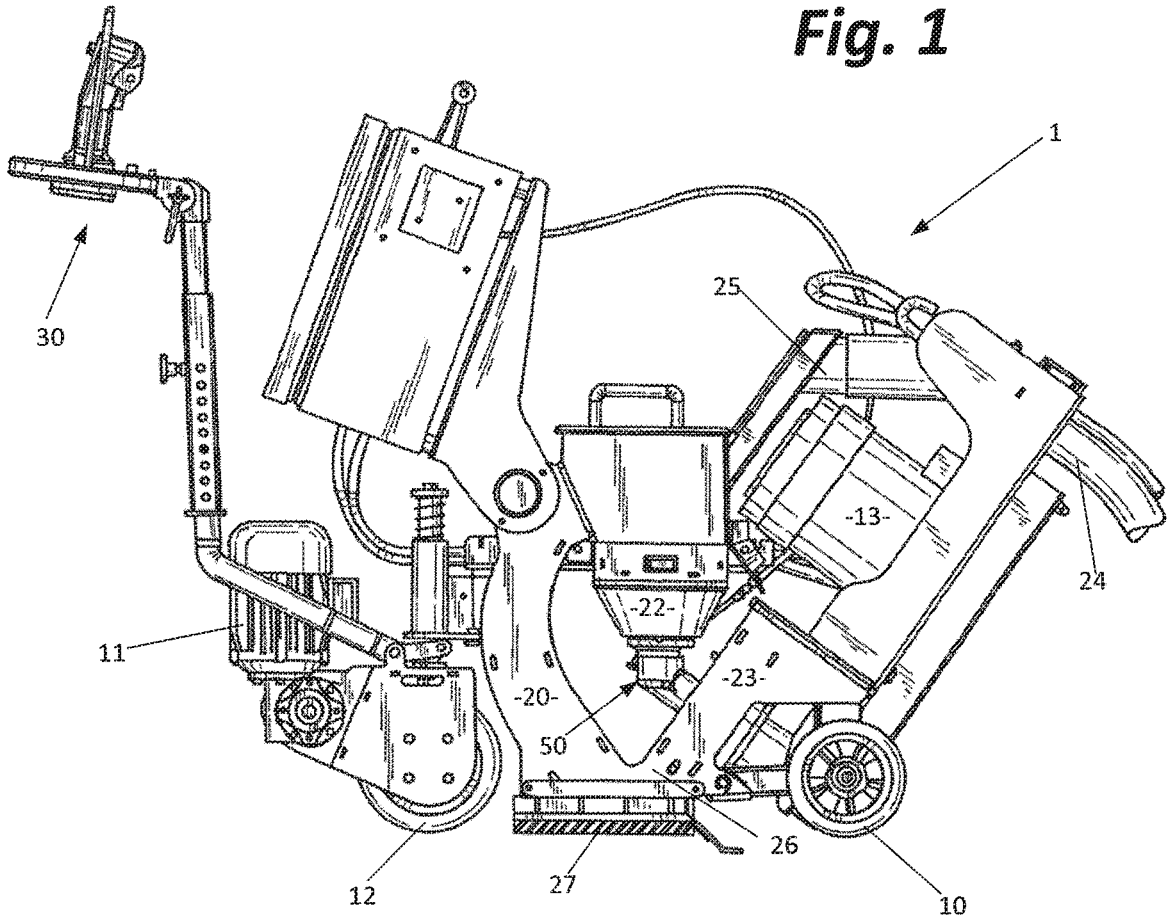
FIG. 1 is a side view of shot blaster.
Figure 2:
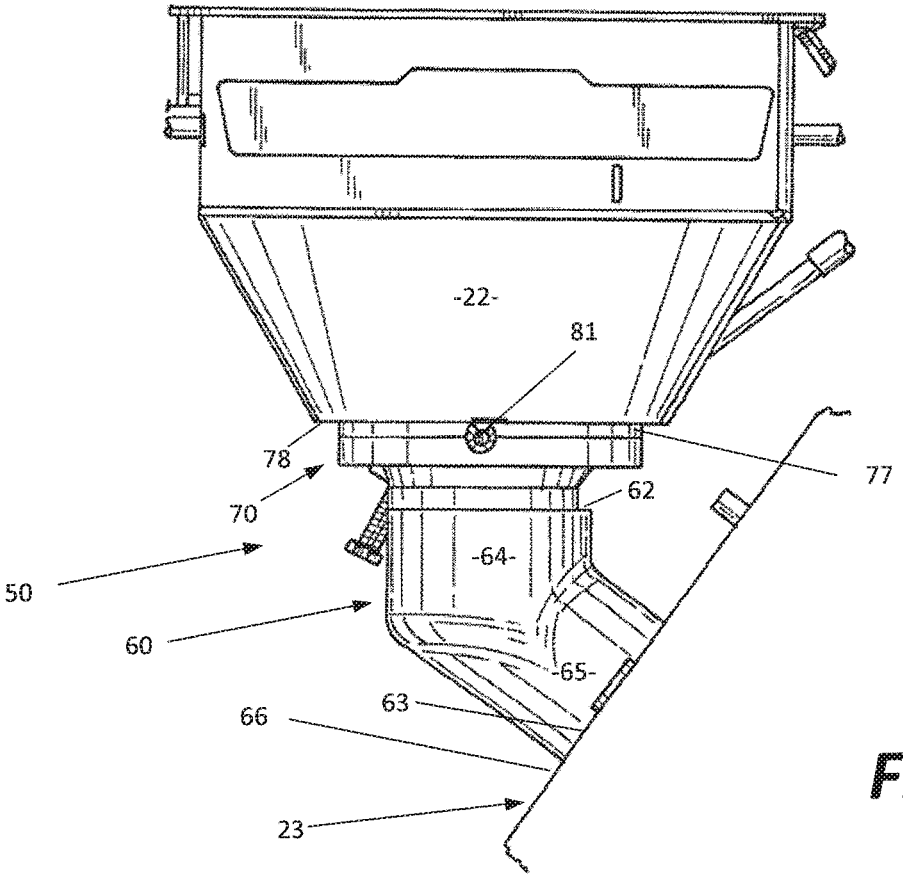
FIG. 2 is a view showing a sleeve and valve mount assembly adapted to provide a flow of shot between a shot reservoir and a blast housing.
Figure 3:
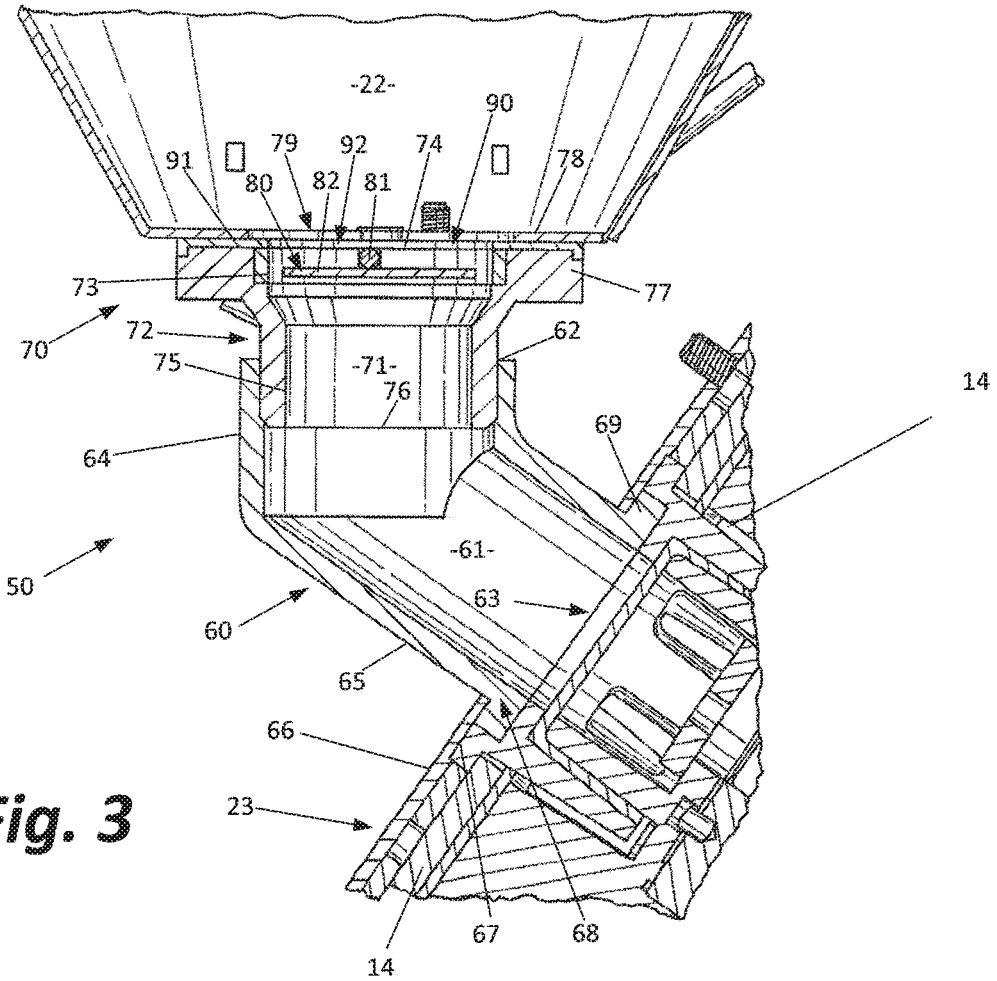
FIG. 3 is a cross-sectional view of the assembly of FIG. 2.
Figure 4:
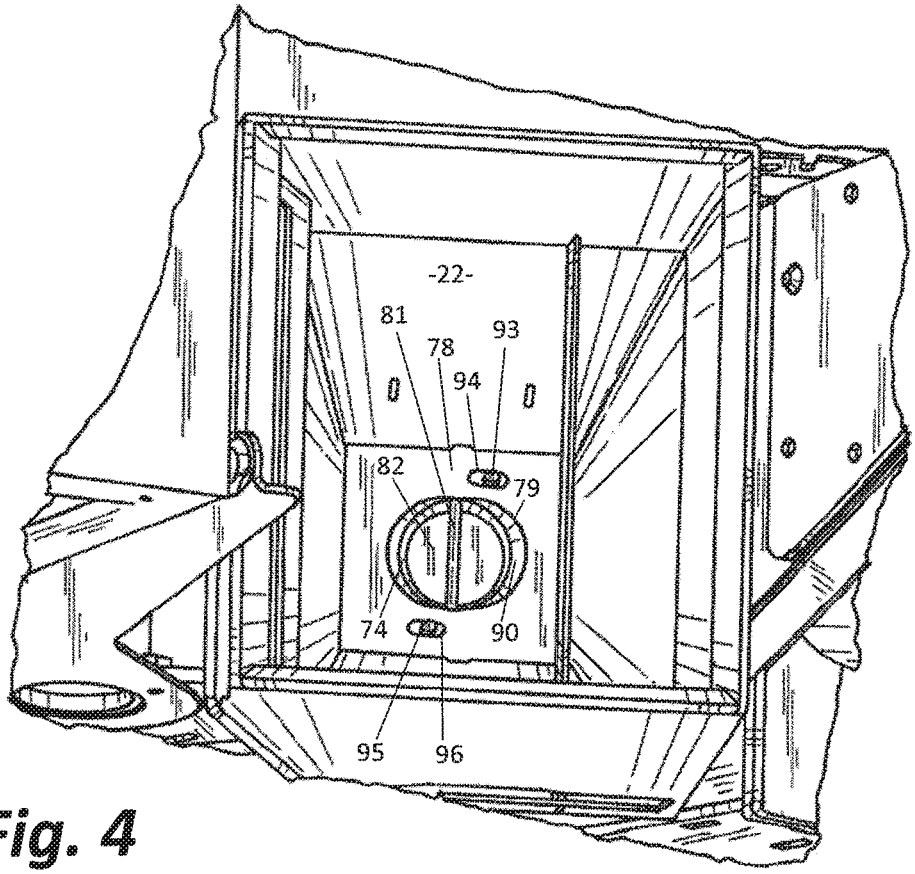
FIG. 4 is a top view of the reservoir and orifice adaptor of the assembly of FIG. 2.

This description of the preferred embodiments is intended to be read in connection with the accompanying drawings, which are to be considered part of the entire written description of this invention. In the description, relative terms such as "lower", "upper", "horizontal", "vertical", "above", "below", "up", "down", "top" and "bottom" as well as derivatives thereof (e.g., "horizontally", "downwardly", "upwardly", etc.) should be construed to refer to the orientation as then described or as shown in the drawings under discussion. These relative terms are for convenience of description and do not require that the apparatus be constructed or operated in a particular orientation. Terms such as "connected", "connecting", "attached", "attaching", "join" and "joining" are used interchangeably and refer to one structure or surface being secured to another structure or surface or integrally fabricated in one piece, unless expressively described otherwise.

A self-propelled shot blasting machine 1 is shown in FIG. 1. The machine 1 sits on a pair of rear wheels 10 and a front drive wheel 12.

Machine 1 is driven by an electric motor 11 coupled to drive wheel 12. The machine 1 has a second motor 13 that drives a blast wheel 14.

The machine 1 also has a plenum 20 incorporating a reservoir 22 adapted to contain a supply of shot and a blast wheel housing 23 surrounding the blast wheel 14. The plenum 20 is coupled to one end of a vacuum tube 24 by a fitting (or port) 25. The other end of the vacuum tube 24 is coupled to a vacuum (not shown).

Reservoir 22 is filled with shot prior to use. The vacuum is then energized to create air flow through the vacuum tube 24 and plenum 20. The motors 11 and 13 are then energized. Energizing motor 13 causes the blast wheel 14 to spin inside the blast wheel housing 23. Shot is metered from reservoir 22 into the blast wheel housing 23 where the blast wheel 14 is located. The blast wheel 14 accelerates the shot toward a spout opening 26 at the base of the blast wheel housing 23 adjacent the floor and in an area contained by a suction head 27. As the shot impacts the floor's surface roughening the surface, the shot, together with floor debris and dust, are carried through the plenum 20 by the air flow. The dust and debris are carried to the vacuum. The shot is deposited back into the reservoir (hopper) 22 and recycled.

Operation of the two motors 11 and 13, and the speed and direction of the machine, are controlled by ergonomic controller 30.

As shown in the drawings, the reservoir 22 has a bottom wall 78 having a bottom wall orifice 79. The shot blaster housing 23 has a wall 66 with an inner surface 67 and a wall opening 68.

The shot needs to be transferred from the reservoir 22 to the blast wheel housing 23. This is achieved by providing a shot meter 50 having at least three components including a sleeve 60, a valve mount 70, and a valve 80. An orifice adaptor 90 may also be provided.

The sleeve 60 comprises a first channel 61 extending between a first open end 62 and a second open end 63. The channel 61 is defined by a first wall section 64 surrounding and extending from the first open end 62 and a second wall section 65 angled from the first wall section 64 and surrounding and extending from the second open end 63. The sleeve 60 is adapted to extend through the wall opening 68 in wall 66 of the blast wheel housing 23. The second open end 63 is surrounded by a sleeve flange 69 adapted to engage an area of the inner surface 67 of the wall 66 of the blast wheel housing 23 surrounding the wall opening 63. The flange 69 may alternatively be coupled to the outer surface of the wall 66.

The valve mount 70 has a second channel 71 defined by a conduit 72 having a top section 73 surrounding a top opening 74 and a bottom section 75 surrounding a bottom opening 76. A conduit flange 77 extends from the top section 73 surrounding the top opening 74. The conduit flange 77 is adapted to be coupled to a bottom wall 78 of the reservoir 22 about a bottom orifice 79 passing through the bottom wall 78.

More specifically, the valve mount 70 may be provided with a pair of upwardly protecting attachment pins 93/95 (which may be bolts) extending through elongate slots 94/96 in the bottom wall 78 of the reservoir 22. The pins 93/95 are adapted to slide back and forth in these slots 94/96 so that the valve mount may be properly positioned relative to the bottom wall and bottom orifice of reservoir 22. The pins 93/95 are threaded. Standard washers and nuts (not shown) cooperate with the pins 93/95 to fix the plate 91 and bottom wall 78 of reservoir 22 together. The nuts are tightened when the plate orifice 92 is in the desired alignment relative to the orifice 79 of the bottom wall 78 of reservoir 22. One skilled in the art will recognize that the slots may be in the flange 77 of the valve mount 70 (rather than the bottom wall 79 of the reservoir 22) without deviating from the invention.

The bottom section 75 of the conduit 72 of the valve mount 70 is adapted to be inserted into the first open end 62 of the sleeve 60 to form a joint. Further, the valve mount 70 and first wall section 64 of the sleeve 60 are adapted to telescope with respect to each other. The joint between the valve mount 70 and the first wall section 64 is sufficiently loose to permit such to occur, yet tight enough to prevent shot from exiting through the joint.

The valve 80 is mounted in second channel 71 of the valve mount 70. This valve 80 may be of any suitable type, for example a butterfly valve. When a butterfly valve is employed, the butterfly valve comprises an axle 81 extending across a diameter of the second channel 71 and a leaflet 82 coupled to the axle 81. The leaflet 82 and axle 81 are adapted to rotate relative to the valve mount 70 between a closed position restricting the flow of shot and an open position permitting shot to flow from the reservoir 22. The open position is selectable between different degrees of opening to regulate the rate of flow of shot from the reservoir 22 past the valve 80.

An orifice adaptor 90 may be mounted upstream of the valve 80. In some embodiments, the orifice adaptor 90 comprises a plate 91 having plate orifice 92 adapted to be adjustably aligned relative to bottom orifice 79 of the reservoir 22 to regulate the effective size of a flow path between the bottom orifice 79 of the reservoir 22 and the top opening 74 of the valve mount 70.

Either or both the valve 80 and the orifice adaptor 90 may be adjusted to regulate the flow of shot from the reservoir 22 through the valve mount 70 and sleeve 60 to the shot wheel housing 23.

Warpage of the parts is addressed in various ways by the disclosed embodiments of the present invention. First, the sleeve 60 and valve mount 70 are adapted to permit telescoping of the valve mount 70 with the sleeve 60 to accommodate such warpage. More specifically, the bottom section 75 Of the valve mount 70 is adapted to be coupled to the sleeve 60 by inserting the bottom section 75 into the first channel 61 through the first open end 62 of the sleeve 60. Further, the valve mount 70 and the sleeve 60 are adapted to reciprocate with respect to each other while the bottom section 75 remains coupled to the sleeve 60.

Second, the slots 94/96 and the pins 93/95 permit the position of the flange 77 and top opening 74 of the valve mount 70 to be adjusted relative to the bottom wall 78 and the bottom wall orifice 79 of the reservoir 22.

Third, the orifice adaptor 90 permits the effective area of the flow path leading from the reservoir 22 to the valve 80 to be adjusted for better control of the flow of the shot from the reservoir 22 to the valve 80.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

The invention claimed is:

1. A shot blaster comprising:

a. a reservoir comprising a bottom wall having a bottom orifice, said reservoir adapted to contain a supply of shot;

b. a blast wheel housing comprising a wall having an inner surface and a wall opening, said blast wheel housing adapted to contain a blast wheel; and c. a shot meter comprising:

i. a sleeve comprising a first channel extending between a first open end and a second open end, said second open end surrounded by a sleeve flange adapted to engage an area of the wall of the blast wheel housing surrounding the wall opening;

ii. a valve mount having at least one upwardly protecting attachment pin extending through an elongate slot in the bottom wall of the reservoir, a second channel defined by a conduit having a top section surrounding a top opening and a bottom section surrounding a bottom opening, a conduit flange extending from the top section surrounding the top opening, said conduit flange adapted to be selectively positioned and coupled to the bottom wall of the reservoir about the bottom orifice, wherein the bottom section is adapted to be coupled to the sleeve by inserting the bottom section into the first channel through the first open end of the sleeve, and wherein the valve mount and the sleeve are adapted to reciprocate with respect to each other while the bottom section remains coupled to the sleeve.

2. The shot blaster of claim 1 further comprising an orifice adaptor having a plate and a plate orifice adapted to be adjustably aligned relative to the bottom orifice to regulate the effective size of a flow path between the bottom orifice and the top opening of the valve mount.

3. The shot blaster of claim 1 wherein the attachment pin is threaded and adapted to receive a washer and nut to secure the valve mount in a desired position relative to the bottom wall and bottom orifice of the reservoir.

4. The shot blaster of claim 1 further comprising a valve regulating flow through the second channel.

5. The shot blaster of claim 4 wherein the valve comprises an axle extending across the diameter of the second channel and a leaflet coupled to the axle, wherein said leaflet and axle are adapted to rotate relative to the valve mount between a closed position restricting the flow of shot and an open position permitting shot to flow from the reservoir.

6. The shot blaster of claim 5 wherein said open position is selectable between different degrees of opening to regulate the rate of flow of shot from the reservoir past the valve.

7. A shot blaster comprising:

a. a reservoir comprising a bottom wall having a bottom orifice, said reservoir adapted to contain a supply of shot;

b. a blast wheel housing comprising a wall having an inner surface and a wall opening, said blast wheel housing adapted to contain a blast wheel;

c. a shot meter comprising:

i. a sleeve comprising a first channel extending between a first open end and a second open end, said channel defined by a first wall section surrounding and extending from the first open end and a second wall section angled from the first wall section and surrounding and extending from the second open end, said sleeve adapted to extend from the opening of the blast wheel housing, said second open end surrounded by a sleeve flange adapted to be coupled to the wall of the blast wheel housing about the wall opening;

ii. a valve mount having at least one upwardly protecting attachment pin extending through an elongate slot in the bottom wall of the reservoir, a second channel defined by a conduit having a top section surrounding a top opening and a bottom section surrounding a bottom opening, a conduit flange extending from the top section surrounding the top opening, said conduit flange adapted to be selectively positioned and coupled to the bottom wall of the reservoir about the bottom orifice, wherein the bottom section is adapted to be coupled to the sleeve by inserting the bottom section into the first channel through the first open end of the sleeve, and wherein the valve mount and the sleeve are adapted to reciprocate with respect to each other while the bottom section remains coupled to the sleeve; and iii. a valve mounted in the second channel of the valve mount.

8. The shot blaster of claim 7 further comprising an orifice adaptor having a plate having a plate orifice adapted to be adjustably aligned relative to the bottom orifice to regulate the effective size of a flow path between the bottom orifice and the top opening of the valve mount.

9. The shot blaster of claim 7 wherein the attachment pin is threaded and adapted to receive a washer and nut to secure the valve mount in a desired position relative to the bottom wall and bottom orifice of the reservoir.

10. The shot blaster of claim 7 wherein the valve comprises an axle extending across the diameter of the second channel and a leaflet coupled to the axle, wherein said leaflet and axle are adapted to rotate relative to the valve mount between a closed position restricting the flow of shot and an open position permitting shot to flow from the reservoir.

11. The shot blaster of claim 10 wherein said open position is selectable between different degrees of opening to regulate the rate of flow of shot from the reservoir past the valve.

12. A shot blaster comprising:

a. a reservoir comprising a bottom wall having a bottom orifice, said reservoir adapted to contain a supply of shot;

b. a blast wheel housing comprising a wall having an inner surface and a wall opening, said blast wheel housing adapted to contain a blast wheel;

c. a shot meter comprising:

i. a sleeve comprising a first channel extending between a first open end and a second open end, said channel defined by a first wall section surrounding and extending from the first open end and a second wall section angled from the first wall section and surrounding and extending from the second open end, said second open end surrounded by a sleeve flange adapted to engage an area of the wall of the blast wheel housing surrounding the wall opening;

ii. a valve mount having at least one upwardly projecting attachment pin extending through an elongate slot in the bottom wall of the reservoir, a second channel defined by a conduit having a top section surrounding a top opening and a bottom section surrounding a bottom opening, a conduit flange extending from the top section surrounding the top opening, said conduit flange adapted to be selectively positioned and coupled to the bottom wall of the reservoir about the bottom orifice, wherein the bottom section is adapted to be coupled to the sleeve by inserting the bottom section into the first channel through the first open end of the sleeve, and wherein the valve mount and the sleeve are adapted to reciprocate with respect to each other while the bottom section remains coupled to the sleeve;

iii. a valve mounted in the second channel of the valve mount;

iv. an orifice adaptor mounted upstream of the valve;

wherein the valve and the orifice adaptor are adjustable to regulate the flow of shot from the reservoir through the valve mount and sleeve to the blast wheel housing.

13. The shot blaster of claim 12 wherein the orifice adaptor comprises a plate having a plate orifice adapted to be adjustably aligned relative to the bottom orifice to regulate the effective size of a flow path between the bottom orifice and the top opening of the valve mount.

14. The shot blaster of claim 12 wherein the attachment pin is threaded and adapted to receive a washer and nut to secure the valve mount in a desired position relative to the bottom wall and bottom orifice of the reservoir.

15. The shot blaster of claim 12 wherein the valve comprises an axle extending across the diameter of the second channel and a leaflet coupled to the axle, wherein said leaflet and axle are adapted to rotate relative to the valve mount between a closed position restricting the flow of shot and an open position permitting shot to flow from the reservoir.

16. The shot blaster of claim 15 wherein said open position is selectable between different degrees of opening to regulate the rate of flow of shot from the reservoir past the valve.

* * * * *